US006379291B1

(12) United States Patent
Wild et al.

(10) Patent No.: US 6,379,291 B1
(45) Date of Patent: Apr. 30, 2002

(54) METHOD AND APPARATUS FOR PRODUCING AND PACKING FOIL BAGS

(75) Inventors: Hans-Peter Wild, Zug; Eberhard Kraft, Neckarbischofsheim, both of (DE)

(73) Assignee: Indag GmbH & Co. Betriebs-KG, Heidelberg (DE)

( * ) Notice: Subject to any disclaimer, the term of this patent is extended or adjusted under 35 U.S.C. 154(b) by 0 days.

(21) Appl. No.: 09/317,367

(22) Filed: May 24, 1999

(30) Foreign Application Priority Data

Jun. 4, 1998 (DE) ..... 198 25 065

(51) Int. Cl.[7] ..... B31B 1/64

(52) U.S. Cl. ..... 493/204; 493/210; 493/223; 493/227

(58) Field of Search ..... 493/194, 204, 493/186, 189, 196, 199, 210, 227, 223

(56) References Cited

U.S. PATENT DOCUMENTS

| | | | | |
|---|---|---|---|---|
| 3,380,646 A | | 4/1968 | Doyen et al. | 229/57 |
| 3,631,940 A | | 1/1972 | Richins | 182/148 |
| 4,235,659 A | * | 11/1980 | Achelpohl | |
| 4,270,908 A | * | 6/1981 | Lehmacher | |
| 4,342,564 A | * | 8/1982 | Lehmacher | |
| 4,396,379 A | * | 8/1983 | White et al. | 493/194 |
| 4,487,599 A | * | 12/1984 | Bendig et al. | 493/194 |
| 5,085,111 A | * | 2/1992 | Birkhofer | |

FOREIGN PATENT DOCUMENTS

| | | |
|---|---|---|
| AT | 368973 | 11/1982 |
| CA | 2152172 | 7/1994 |
| DE | 2236524 | 2/1974 |
| DE | 2 305 121 | 8/1974 |
| DE | 2442610 A1 | 3/1976 |
| DE | 2534306 A1 | 7/1976 |
| DE | 2513776 A1 | 10/1976 |
| DE | 2700971 A1 | 8/1977 |
| DE | 3425430 A1 | 1/1986 |
| DE | 3631940 A1 | 4/1987 |
| DE | 3727339 A1 | 3/1989 |
| DE | 4114255 A1 | 4/1992 |
| DE | 41 02 877 A1 | 8/1992 |
| DE | 4225061 A1 | 3/1993 |
| DE | 4446104 A1 | 7/1996 |
| DE | 19502830 A1 | 8/1996 |
| DE | 29521183 U1 | 11/1996 |
| DE | 4446104 C2 | 4/1997 |
| EP | 0 624 458 B1 | 11/1994 |
| HU | 201 700 B | 12/1990 |
| HU | 211 061 B | 10/1995 |
| WO | WO91/18797 | 12/1991 |

* cited by examiner

*Primary Examiner*—Eugene Kim
(74) *Attorney, Agent, or Firm*—SEED IP Law Group PLLC

(57) ABSTRACT

The present invention relates to a foil-bag producing and packing apparatus comprising at least two feed means for feeding foil material, a connecting means for connecting the foil material fed, the connecting portions—in a direction transverse to the feed direction—extending over the foil width, a cutting means for cutting the connected foil bags along the connecting portions, and a storing device which directly after the cutting process stores the foil bags substantially in the direction of movement of the cutting edge and stacks the same in a receiving means. Moreover, the invention comprises a corresponding method for producing and packing foil bags.

14 Claims, 4 Drawing Sheets

METHOD AND APPARATUS FOR PRODUCING AND PACKING FOIL BAGS

CROSS-REFERENCE TO RELATED APPLICATION

This application claims priority from German Patent Application No. 198 25 065.7, filed Jun. 4, 1998.

TECHNICAL FIELD

The present invention relates to a foil-bag producing and packing apparatus, in particular for foil bags for beverages, the apparatus comprising at least two feed means for feeding the foil material, a connecting means for connecting said foil materials and a cutting means for cutting the connected foil materials into individual foil bags, and to a method for producing and packing foil bags.

BACKGROUND OF THE INVENTION

Foil bags are used for receiving filling material, such as beverages. Such foil bags consist e.g. of two side foils which are connected, e.g. sealed or welded, to each other at two opposite edges. A bottom foil which in the folded-apart state constitutes a standing base and forms a space for the filling material between the side foils is inserted between the corresponding third edges.

In a foil-bag producing process, at least those two foils are supplied that serve as side foils of the foil bag. The foils are normally supplied in one piece by corresponding supply rolls. The individual foils are placed one upon the other and are sealed or bonded to each other at least at the place where the side edges of the foil bag are located. The interconnected foil webs are then cut along the connections to form individual foil bags. The foil bags produced in this manner, which are closed at three side edges, can e.g. directly be supplied to a filling station in which the filling material is filled in through the fourth edge that has not been closed yet, and are then sealed or bonded.

However, the foil bags which are already closed at three sides can also be united in a packing unit, stacked and transported to a different place in order to be filled.

It is here very important that a high packing density as well as a high stacking accuracy are achieved to keep the transportation volume as small as possible.

SUMMARY OF THE INVENTION

It is the object of the present invention to provide an improved foil-bag producing and packing apparatus and a corresponding method by which it is possible to cut the interconnected foils in an easy and reliable manner and to pack the individual foil bags in a uniform manner, whereby a high throughput rate is to be achieved.

According to the invention the foil-bag producing and packing apparatus comprises a cutting means including a substantially vertically moving cutting edge which cuts the interconnected foils along the connecting portions into individual foil bags, the cutting edge cutting the whole foil width of the connected foils which are intermittently supplied by a conveying means. Moreover, the apparatus according to the invention comprises a receiving means in which the cut-off foil bags are stacked for further use and in which directly after the cutting process the foil bags are stored and stacked by a storing device substantially in the direction of movement of the cutting edge.

According to the method of the invention the interconnected foil bags are cut by a cutting edge along the connecting portions to form individual foil bags, and the cut-off foil bags are stacked by a storing device substantially in the direction of movement of the cutting edge directly after the cutting operation.

The substantially vertical movement of the cutting edge makes sure that the flexible foil material is bent during the cutting process to a degree which is as small as possible. The cut foil material is stored and stacked in a receiving means directly downstream of the cutting device. The storing operation is performed in the direction of movement of the cutting edge, whereby the direction of the cut-off foil bags need not be changed and an optimum, time-saving and direct storage is made possible. The direction of movement of the cutting edge through the foil material predetermines the corresponding direction of movement which is continued by the storing device. As a result, the packing process is accelerated.

The individual foils can be adhesively connected or hot-bonded to one another to form the foil bags. A particularly advantageous embodiment of the apparatus according to the invention comprises, however, a sealing means as a connecting means so that when the method according to the invention is performed with the apparatus of the invention, weld seams can be formed along the connecting portions. Such weld seams reliably seal the foils to one another and permit a simple cutting process which can be performed in a reliable manner.

The cutting means can be driven with the help of an electromagnetic drive or a mechanism. Of particular advantage is however an embodiment in which the cutting means comprises a pneumatic means controlled at the same rate as the conveying means for moving the cutting edge. Such a pneumatic means permits a very fast cutting process in a reliable and inexpensive manner.

Depending on the respective requirements, the feed direction of the foils and the direction of movement of the cutting edge may differ. Of particular advantage is however a foil-bag producing and packing apparatus in which the conveying means moves the interconnected foils in a horizontal direction and in which the cutting edge moves in a direction substantially vertical thereto. Such an arrangement guarantees a reliable transportation of the foils and a simple storing mechanism which is in the same direction as the direction of movement of the cutting edge.

It is of particular advantage when the foil bags are additionally pressed together during the stacking operation, whereby the packing volume is further reduced. To this end, the stacking device in the apparatus of the invention may comprise elements which are moved at the same rate as the cutting means and which compress already stacked foil bags. Such elements guarantee a reliable transportation of the cut-off foil bags to the already stacked foil bags and additionally compress the same.

The elements may be moved by a separate drive at the rate of the cutting means. A reliable stacking of the cut-off foil bags, which is independent of the length of the movement of the cutting means, is thereby made possible.

In another, particularly simple embodiment, the elements are directly connected to the cutting edge of the cutting means and are moved together with said means. An additional drive for the stacking elements is thus not necessary.

The apparatus of the invention is particularly reliable when a plurality of adjacent fingers are provided in the storing device for storing the cut-off foil bags in the receiving means.

If the fingers are directly connected to the cutting edge of the cutting means, flexible plastic fingers constitute inexpensive and reliable means which by virtue of their flexibility stack the foil bags in a gentle manner.

In a simple embodiment the conveying means comprises at least one intermittently rotating roller which conveys the connected foils by frictional grip.

The method can be performed on a foil web whose width exactly corresponds to one foil bag. A particularly economic design is however achieved when foil webs are processed the width of which corresponds to a plurality of foil bags so that the individual processing steps can be taken on a plurality of foil bags at the same time. To this end, the feeding means, the connecting means, the cutting means and the storing device of the apparatus according to the invention can be designed such that it is possible to process foils of one width whose dimensions correspond to a plurality of foil bags in a direction perpendicular to the supply direction, and a dividing means is additionally provided upstream of the cutting means for cutting the connected foils into parts which in a direction perpendicular to the conveying direction corresponds to the dimension of a foil bag in a direction perpendicular to the conveying direction.

The cutting means of the apparatus of the invention serves to divide the foil web in a direction perpendicular to the feed direction. If foils of one width are processed, with the foils corresponding to a plurality of foil bags, a corresponding number of foil bags is always cut off by the cutting means from the foil web in one operation. A dividing means which is provided in front of the cutting means serves the purpose that the foil web is already divided in front of the cutting means in feed direction and that individual foil bags are thus present after the cutting means has been passed through.

BRIEF DESCRIPTION OF THE DRAWINGS

An embodiment of the apparatus according to the invention as well as the method according to the invention will now be described with reference to the enclosed figures, in which.

DETAILED DESCRIPTION OF THE ILLUSTRATED EMBODIMENTS

Figure 4:
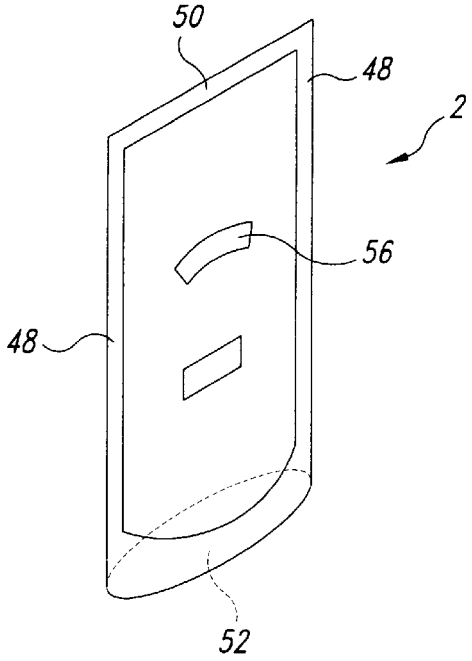
FIG. 4 shows an example of a foil bag.

FIG. 4 shows a finished and filled foil bag, e.g. a foil bag for beverages. The bag is e.g. made from laminated aluminum foils that are sealed or welded to one another. The foil bag 2 comprises two side foils and a bottom foil, which is not visible in FIG. 4. The side foils are sealed to each other along the sealing portions 48. 52 designates the areas in which the side foils are sealingly connected to the bottom foil. The side foils may e.g. have applied thereto imprints 56 about the contents of the foil bag. 50 designates a top weld seam which after the foil bag has been filled is applied to close the bag.

Figure 1:
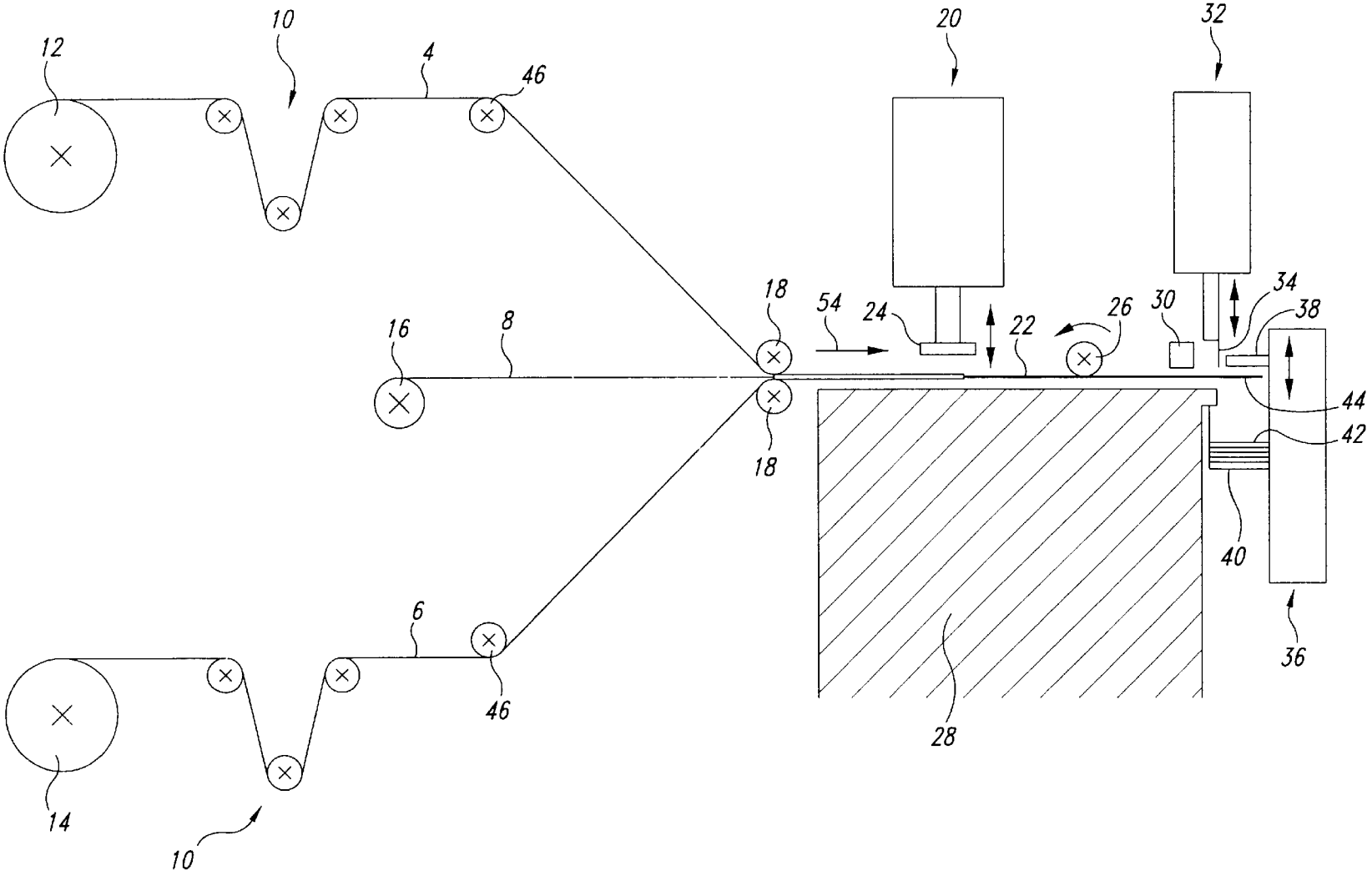
FIG. 1 is a schematic side view of an apparatus according to the invention.

FIG. 1 schematically shows an apparatus of the invention for producing such a foil bag. 12 and 14 designate supply rolls which have wound thereonto foil material for the side foils. 16 designates a supply roll for the bottom foil. The individual foil webs 4, 6 for the side foils run through tensioning devices 10, which are here of no further interest, and around deflection rolls 46 and 18. Similar tensioning devices and deflection rolls may also be provided for the bottom foil 8, but are not shown in FIG. 1 for the sake of clarity. The direction of movement of the united foils is designated by 54. Above a transportation support 28, there is positioned a sealing means 20 which is per se known and includes a sealing head 24 which can be lowered onto the foil material. 26 designates an intermittently operated rotating roller which further transports the united foil material in a direction 54 by frictional grip. 30 designates a dividing means which serves to cut the foil material in feed direction 54 into strips which correspond to the dimensions of individual foil bags in a direction perpendicular to the feed direction 54. Said dividing means may e.g. include a vertically positioned blade or a rotating knife. 32 denotes a cutting means including a blade 34 which can be moved intermittently through the foil material in downward direction The direction of movement of the blade is here substantially vertical. The blade 34 can here be arranged in an inclined manner in horizontal direction. The knife 34 is arranged such that it is guided past the end edge of the support 28. 36 designates a storing device for storing the foil bags 42 in a receiving means 40. 44 designates a piece of the foil material which is to be cut off and put into the receiving means 40 with the aid of the storing fingers 38.

Figure 2C:
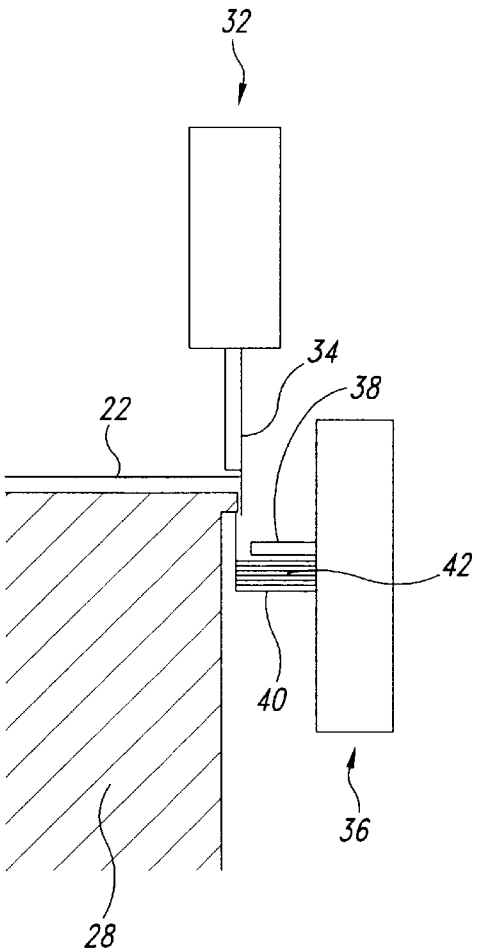
FIG. 2*c* shows the same part of the apparatus of the invention during the storing process.
Figure 2B:
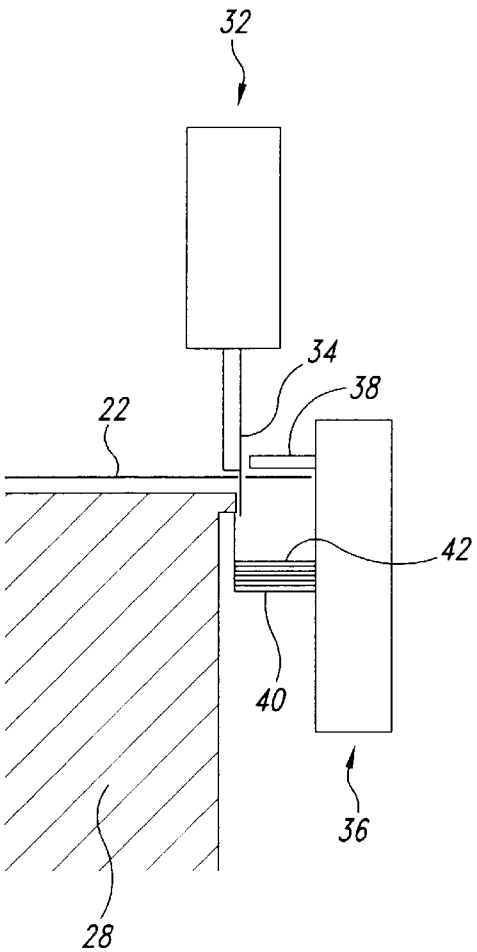
FIG. 2*b* shows the same part of the apparatus of the invention during the cutting process.
Figure 2A:
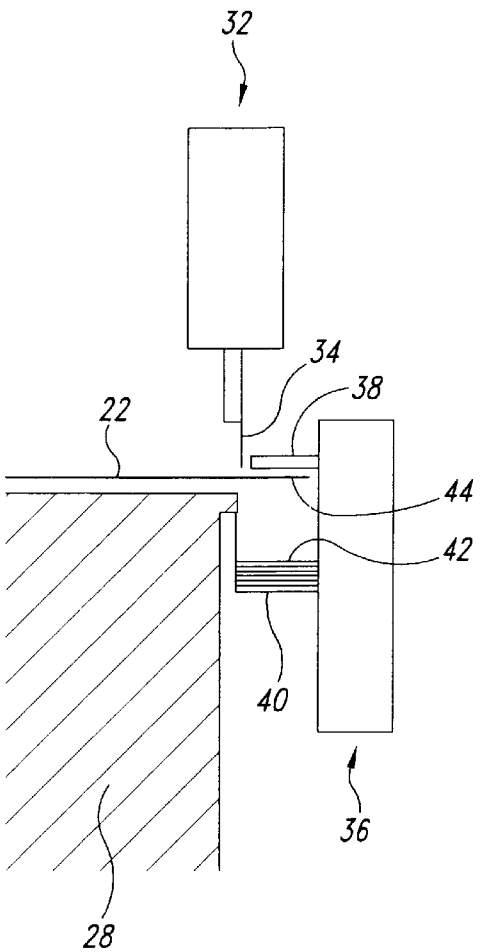
FIG. 2*a* illustrates a detail of FIG. 1, showing the cutting portion shortly before a cutting process.

FIG. 2*a* shows a detail of the foil-bag producing and packing apparatus shown in FIG. 2, in the same state. 22 designates the supplied foil material from which a piece 44, which corresponds to the dimension of one foil bag in feed direction 54, is to be cut off.

Figure 3:
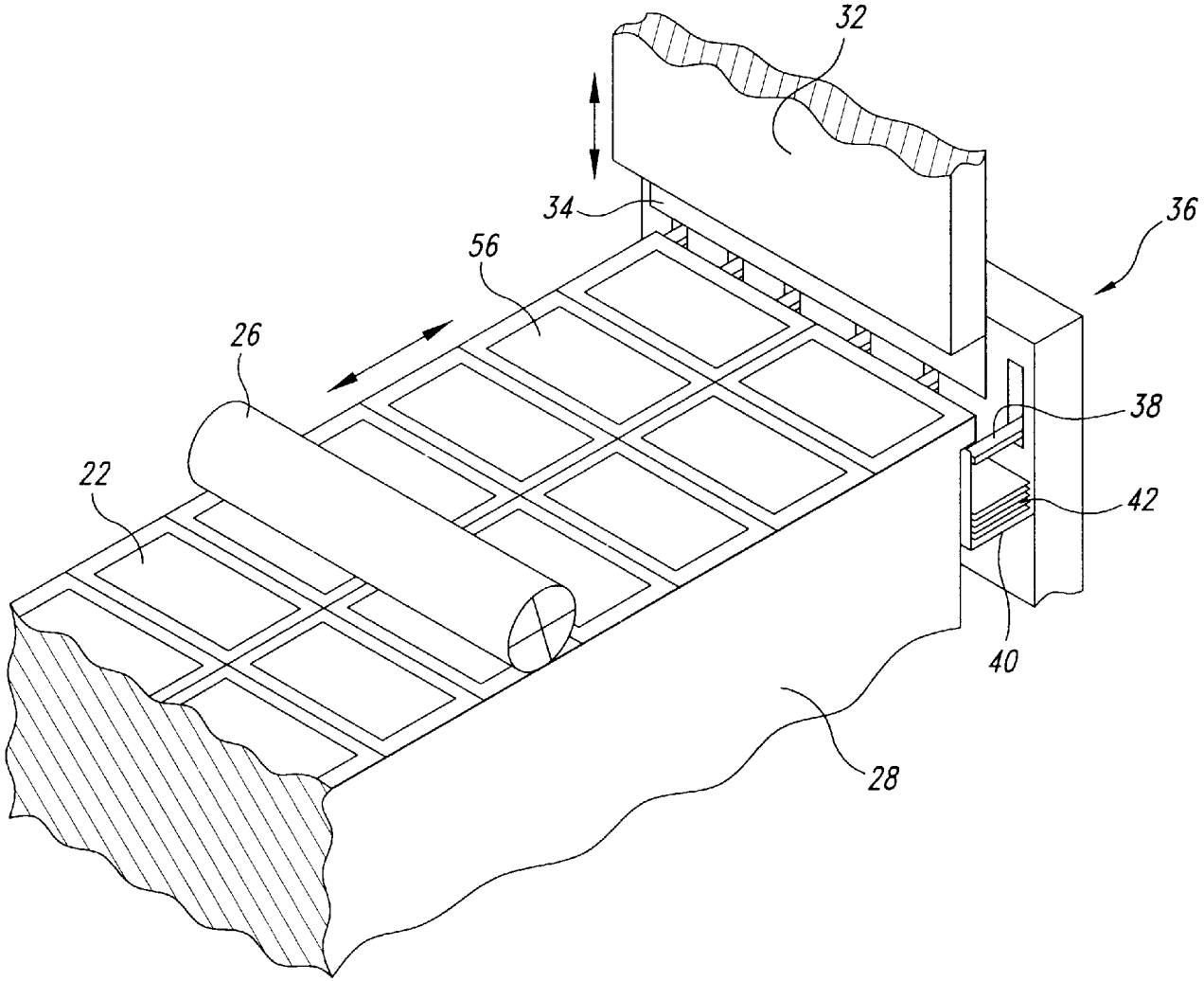
FIG. 3 is a perspective view of the same part of the apparatus according to the invention.

FIG. 2*b* shows the cutting process in detail. Finally, FIG. 2*c* shows how the cut-off foil bag is stored in the receiving means 40. FIG. 3 is a perspective view of the same detail of the apparatus according to the invention shortly after the storing process. The dividing means 30, which may be positioned between the conveying means 26 and the cutting means 32, is not shown for the sake of clarity.

Figure 5:
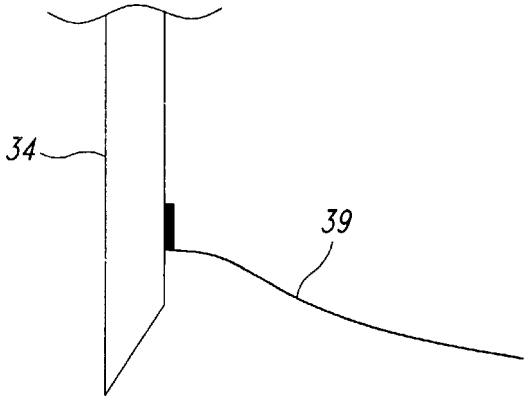
FIG. 5 shows a detail of an alternative embodiment of the storing device.

FIG. 5 shows the blade 34 in another embodiment with plastic fingers 39. A plurality of such plastic fingers 39 may be arranged side by side along the blade 34. The plastic fingers 39 are firmly connected to the blade 34 and are of a flexible type.

With the apparatus according to the invention, the method of the invention can be carried out as follows: The side foils 4 and 6 are withdawn from the supply rolls 12 and 14. The bottom foil 8 is withdrawn from the supply roll 16. Such a withdrawal action can be accomplished with the force which is exerted by the conveying roller 26 by frictional grip on the foil material. However, it is also possible to provide other withdrawal means or motor-driven supply rollers. It is ensured with the help of the tensioning means 10 that the foils are always under an adequate tension after they have been guided around deflection rolls 46 and 18 and united in this manner. The foil material 22 which has been united in the correct sequence is supplied by the conveying roller 26 to the sealing means 20. The sealing head 24 is lowered onto the foil material. Corresponding portions of the sealing head 24 along which the foil materials in their layer sequence are to be sealed to one another are heated accordingly and help to seal the materials. In the example of a beverage foil bag 2, as is shown in FIG. 4, the portions sealed are the side edges 48 and the bottom side portion 52. The sealing head 24 is again lifted and the foil material is further transported by the conveying roller 26.

The illustrated example refers to an apparatus which can process a foil material having a width corresponding to a plurality of foil bags. FIG. 3 shows, for example, two foil bags which are to be processed side by side and at the same time.

To separate the bags from one another in the feed direction, the bags are guided through the dividing means 30 which divides the foil web into two parts, the exact cutting mechanism being here of no interest. The dividing means 30 is not shown in FIG. 3 for the sake of clarity. Use could also be made of devices in which a different number of foil bags are processed at the same time and side by side. As a consequence, the dividing means must then comprise a corresponding number of knives or rotating blades.

The foil layer sequence cut in this way in the longitudinal direction in accordance with the dimensions of individual foil bags then reaches the end of the support 28. As soon as a piece of the foil layer sequence, which in feed direction 54 corresponds to the dimensions of one foil bag, projects beyond the support 28, the cutting edge 34 of the cutting means 32 is moved downwards with the aid of a pneumatic means, so that individual foil bags are cut off. At the same time, the fingers of the storing device 36 move downwards, thereby pushing the cut-off foil bags 42 downwards. The cut-off foil bags 42 are thereby placed on the foil bags already stacked in the receiving means 40. The fingers 38 press the stack together. This is e.g. shown in FIG. 2*c* and FIG. 3, respectively.

FIG. 2*b* shows the state in which the blade 34 passes through the sealed foil material 22.

The foil material is thus cut in a uniform manner thanks to the vertical movement of the blade and can be stored in a space-saving manner.

In contrast to the embodiment shown in FIGS. 1 to 3, it is also possible to provide plastic fingers 39 which are directly connected to the blade 34, as shown in FIG. 5. Plastic fingers of such a flexible type require no additional drive and help to stack the foil bags in a gentle manner.

The cut-off foil bags are gripped by the downwardly moving fingers 38 immediately after the cutting operation and are moved downwards in the same direction as the direction of movement of the blade 34. A very fast and reliable storing process is thus possible.

The receiving means 40 may e.g. directly contain a packing box in which the foil bags are stacked in this way. However, there are other possibilities of how to transfer the foil bags from the receiving means 40 into corresponding packing units, e.g. with the help of mechanically driven tongs.

The entire apparatus is operated intermittently, one interval corresponding to the advance movement of the foil web over a distance the length of which corresponds to the dimension of one foil bag. The conveying roller 26, the sealing means 20, the cutting means 32 and the storing device 36 are here controlled by a control device (not shown), e.g. a corresponding microprocessor means.

What is claimed is:

1. A foil-bag producing and packing apparatus for foil bags for beverages, comprising at least two supply means for supplying foil material;

a connecting means for connecting the supplied foil material in such a manner that the connecting portions extend over the foil width in a direction transverse to the supply direction;

a cutting means including a vertically moveable cutting edge which cuts the interconnected foils at a cutting rate along the connecting portions into individual foil bags;

a conveying means which intermittently supplies the cutting means with a piece of the connected foils that corresponds to the dimensions of one foil bag, the piece projecting unsupported beyond a support that is located upstream of the cutting means to be cut by the cutting means in that position;

a receiving means in which the cut-off foil bags are stacked for further use;

a storing device which directly after each cutting step pushes and moves the foil bag substantially in the direction of movement of the cutting edge and stacks it in the receiving means, the storing device having at least one element that urges the foil bags toward the receiving means at the cutting rate of the cutting means;

the at least one element is connected to the cutting edge such that is moved together with the blade; and the at least one element comprises a plurality of adjacent fingers that are flexible plastic fingers secured to the cutting edge.

2. The apparatus according to claim 1, wherein the connecting means comprises a sealing means.

3. The apparatus according to claim 1, wherein the cutting means comprises a pneumatic means which is controlled at the rate of the conveying means for moving the cutting edge.

4. The apparatus according to claim 1, wherein the connected are moved by the conveying means substantially in a horizontal direction.

5. The apparatus according to claim 1, wherein the storing device comprises at least one element which is moved at the rate of the cutting means and which compresses the already stacked foil bags.

6. The apparatus according to claim 5, wherein the at least one element is driven independently of the cutting means, but at the same rate.

7. The apparatus according to claim 1, wherein the conveying means comprises at least one intermittently rotating roller which further conveys the connected foils by frictional grip.

8. The apparatus according to claim 1, wherein the feed means, the connecting means, the cutting means and the storing device are configured to process foils of a width in a direction perpendicular to the feed direction, corresponding to the dimensions of a plurality of foil bags, and upstream of the cutting means there is provided a dividing means which cuts the connected foils into parts which in a direction perpendicular to the conveying direction correspond to the dimension of one foil bag.

9. A method for producing and packing foil bags for beverages, wherein at least two foils are supplied intermittently, connected along connecting portions oriented in a direction traverse to the feed direction, the connecting portions being spaced apart in the feed direction at a distance corresponding to the dimension of one foil bag, the foils connected in this manner are cut at a cutting rate by a substantially vertically moving cutting edge along the connecting portions for forming individual foil bags, whereby a piece of the foils that corresponds to the dimensions of one foil bag projects unsupported beyond a support and is cut for forming the individual foil bag and, directly after each cutting operation, the separated foil bag is pushed and moved at the cutting rate by a storing device substantially in the direction of movement of the cutting edge, wherein the storing device comprises at least one element that is connected to the cutting edge such that it is moved together with the blade and the at least one element comprises a plurality of adjacent fingers that are flexible plastic fingers secured to the cutting edge.

10. The method according to claim 9, wherein the connecting portions comprise weld seams along which the foils are sealed to one another.

11. The method according to claim 9, wherein the connected foils are fed to the cutting means in a substantially horizontal direction.

12. The method according to claim 9, wherein the stacked foil bags are compressed by the storing device.

13. The method according to claim 9, wherein a plurality of foil bags are cut off side by side by a joint cutting device and are stacked by a joint storing device.

14. A method for cutting and stacking foil bags for beverages, wherein at least two foils are intermittently supplied in a feed direction, the two foils are connected along connecting portions oriented in a direction traverse to the feed direction, and the connecting portions are spaced apart in the feed direction by a distance corresponding to a dimension of one foil bag, the method comprising:

intermittently projecting a length of the connected foils that corresponds to the dimension of one foil bag, the projecting length being unsupported;

intermittently cutting each unsupported length of the connected foils at a cutting rate by moving a substantially vertical cutting edge along the connecting portions to form an individual foil bag; and immediately after each cutting operation, pushing and moving each individual foil bag at the cutting rate in the direction of the movement of the cutting edge, wherein the device for pushing and moving the foil bags comprises at least one element that is connected to the cutting edge such that it is moved together with the blade and the at least one element comprises a plurality of adjacent fingers that are flexible plastic fingers secured to the cutting edge.

* * * * *

UNITED STATES PATENT AND TRADEMARK OFFICE

CERTIFICATE OF CORRECTION

PATENT NO. : 6,379,291 B1
DATED : April 30, 2002
INVENTOR(S) : Hans-Peter Wild et al.

It is certified that error appears in the above-identified patent and that said Letters Patent is hereby corrected as shown below:

Title page,
Item [75], Inventors, "Hans-Peter Wild, Zug; Eberhard Kraft, Neckarbischofsheim, both of (DE)" should be corrected to read -- Hans-Peter Wild, Zug (CH), Eberhard Kraft, Neckarbischofsheim (DE) --.

Signed and Sealed this

Twenty-third Day of July, 2002

*Attest:*

*Attesting Officer*

JAMES E. ROGAN
*Director of the United States Patent and Trademark Office*